United States Patent [19]

Sader

[11] 4,376,040

[45] Mar. 8, 1983

[54] PROCESS FOR TREATING AND REGENERATING USED OIL PRODUCTS

[76] Inventor: Gabriel Sader, 23, rue du Chemin Vert, 75011 Paris, France

[21] Appl. No.: 258,535

[22] Filed: Apr. 28, 1981

[30] Foreign Application Priority Data

Apr. 29, 1980 [FR] France ..... 80 09586

[51] Int. Cl.[3] ..... C10M 11/00

[52] U.S. Cl. ..... 208/180; 208/13; 210/725; 210/729

[58] Field of Search ..... 208/13, 180; 210/708, 210/725, 727, 729, 738, 749

[56] References Cited

U.S. PATENT DOCUMENTS 1,469,426 10/1923 Miller ..... 208/180
3,123,442 3/1964 Karsay et al. ..... 208/13
4,105,538 8/1978 Mattox ..... 208/180
4,130,674 12/1978 Roberts et al. ..... 210/729
4,184,949 1/1980 Sader ..... 210/727

FOREIGN PATENT DOCUMENTS 54-4278 1/1979 Japan ..... 208/180

*Primary Examiner*—Ivars C. Cintins
*Attorney, Agent, or Firm*—Browdy and Neimark

[57] ABSTRACT

In the recovery of regenerated mineral and synthetic oils from blackish dirty lubricating or industrial oils, a quaternary ammonium salt or mixture of salts is added to the dirty oil and the mixture is subjected to agitation. The agitated mixture is next subjected to a decanting operation making it possible to recover, as the upper supernatant fraction, an oil exhibiting approximately the same characteristics as a new starting oil useful for automotive engines, transmissions and differentials, as a lubricant for machine tools, useful in transformers and other electric and electropneumatic devices and also useful as a hydraulic fluid.

7 Claims, No Drawings

PROCESS FOR TREATING AND REGENERATING USED OIL PRODUCTS

FIELD OF THE INVENTION

This invention related to the field of oil products, particularly mineral oils. It relates especially to a process for treating used oils to recover a usable oil from such residues.

BACKGROUND OF THE INVENTION

Used oil products, generally considered as bothersome wastes, represent considerable tonnage in various fields of use such as, for example: oils obtained from draining engines and transmissions of various vehicles, oils obtained from mechanical machines or electric devices, various industrial oils, liquid or semifluid wastes of fatty bodies, etc.

At present, most of these oil wastes are either burned or subjected to various regeneration treatments. For example, according to a known process, the dirty oil is dehydrated by heating it at a temperature of about 150°-160 ° C., then subjecting it to treatment with concentrated sulfuric acid. After filtering and heating the dirty oil at about 300° C., two products are obtained. One is regenerated oil of the VEDOL or other type and the other is a blackish muddy residue called "acid mud", the volume of which represents at least 30% of the recovered product after sulfuric acid treatment.

These prior art processes of regenerating dirty oils require the use of several treatment phases and the use of costly and/or dangerous products, such as for example, sulfuric acid in the technique mentioned above.

OBJECTS AND SUMMARY OF THE INVENTION

One of the objects of the invention is to propose a process for making possible the separation of dirt from used oil without resorting to successive complex treatments conducted at high temperatures and which require specially suited equipment.

Another object is to obtain the most complete quantitative separation of impurities possible from a used oil, while recovering a reusable oil containing the usual additives of a new base oil and exhibiting characteristic properties fairly equivalent to the latter.

DETAILED DESCRIPTION OF THE PREFERRED EMBODIMENTS

According to the essential characteristics of the new process of the invention, the dirty oil is agitated, in the presence of a quaternary ammonium salt or mixture of salts, and then is subjected to a decanting operation, the supernatant fraction then being recovered as a regenerated, directly reusable oil.

It has been found in a surprising way, that starting with a black oil, for example, an oil drained from a vehicle, an oil product is recovered still containing additives usually incorporated in a base lubricating oil. Examples of such additives are agents improving the index of viscosity and flow at low temperatures, extreme pressure additives, etc.

Although various quaternary ammonium compounds, preferably containing a fatty chain, could be used in the process (see, for example, C. A. Lawrence, Quaternary Ammonium Germicides, Academia Press, New York, 1950), it is especially advantageous to use quaternary amonium amine or hydroxide halide salts, such as arylammonium halides of the alkyl-dimethylbenzlammonium chloride type or corresponding homologs thereof.

It has been found that the best results are obtained when the decanting adjuvant contains, in its chemical composition, at least one aryl ring substituted by at least one fatty alkyl radical containing 8 to 18 and preferably 12 to 18 carbon atoms. Thus, anionic or non-ionic dispersing or emulsfying agents characterized by this definition are suitable for use within the scope of the invention. However, cationic compounds such as ammonium salts have the advantage of high effectiveness and are reasonably priced.

The amounts of ammonium salt used are obviously a function of and dependent on the type of oil product and dirt or pollutants it contains. In general, 0.1 to 3 parts of $NH_4+$ salt (calculated dry) for 100 parts of used oil are used. In practice, the salt is used in the form of a concentrated aqueous solution, for example 70 to 80%, which is diluted, for example, 5 to 15 times with water. When the dilution is considerable, the aqueous phase, corresponding to the amount of dilution water used, is recovered and separated as a lower decanting layer.

The agitation operation is performed for several minutes using any known means (a mechanical or electromagnetic agitator) either at normal ambient temperature or slightly higher by heating to temperatures of 30° to 50° C. making it possible to obtain complete decanting results in several minutes or several hours rather than in several days.

It has been further found that the rate of separation of dirt and the quality of the oil recovered are often improved when the pH of the operational medium is either close to neutral or somewhat acidic. Dirty lubricating oils, as for example, oils from draining engines, are often slightly acidic.

The quaternary ammonium solution has a slightly basic pH For this reason, it is often desirable to acidify this solution, for example, by adding a weak acid, such as citric acid or the like, so that the treatment medium finally has a slightly acidic pH. However, in other cases and depending on the particular oils treated, decanting is performed most efficiently at neutral or slightly basic pH. Finally, in still other cases, the decanting time can be reduced by introducing, in the agitated used oil, extemporaneously prepared mixtures of an aqueous solution, which is acidified with a $NH_4+$ salt, and an aqueous solution of the same $NH_4+$ salt made basic, for example, by the addition of a small amount of sodium carbonate or the equivalent.

The above process can advantageously be used for very diverse categories of used oils, of course not including edible oils to avoid any harmful effects due to ingestion of the treating agents. Of these regenerable oils, there can be cited particularly: the oils from draining engines, transmissions and/or the differential of automobile and trucks; lubricating oils of machine tools and other mechanisms; oils of transformers and other electric and electropneumatic devices; hydraulic oil and liquids including synthetic oils, etc.

According to another very advantageous application, it has also been found that the process of the invention is also well suited for recovery, in usable form, of the major part of acid black muds, heretofore rejected as unusable residues in the known treatment, mentioned above, for the regeneration of dirty lubricating oils.

Thus, by agitating such a black liquid, containing pollutant particles in suspension, with a ten-fold diluted aqueous solution of a quaternary ammonium salt, then allowing it to decant, these are recovered by the following layers: a heavy layer composed of the diluting layer and the one contained in the acid mud, a very black intermediate layer containing all of the dirt pollutants and a supernatant layer comprising 80–95% of a yellowish oil which is suitable for reuse as a lubricant, after having undergone a neutralizing treatment intended to decrease the acidity of the oil resulting from the great amount of sulfuric acid, which are used in the preliminary phase of regeneration of the used oil.

The invention will be better understood from the detailed description of the following embodiments given by way of non-limiting examples.

EXAMPLES (a) the process of the invention was applied to several blackish extremely dirty oils obtained from draining vehicles in various garages and service stations. The quaternary ammonium salt used was HYAMINE 3500 (trademark, Rohm & Haas; alkyldimethybenzyl ammonium chloride where the alkyl is a mixture of 50% of $C_{14}$, 40% of $C_{12}$ and 10% of $C_{16}$), this salt being designated below as salt A. In practice, aqueous solutions of salts in a concentration of about 10% by weight are used.

TEST 1

There was agitated, at normal temperature for about 2 minutes, 1 liter of drained oil containing 250 ml of solution of salt A (the pH of which was about 8), and then it was allowed to decant. After about 48 hours, the lower black deposit was eliminated (about 2% by volume), and there was recovered as an upper layer (the remaining %) an oil of good consistency.

By performing the same operation while heating at a temperature of about 50° C., the decanting time can be reduced to less than 12 hours.

TEST 2

There were treated, for about 10 minutes, and at a temperature of 40° C., five liters of drained oil containing a mixture of 500 ml of a salt A solution having a pH of about 3, resulting from the addition of citric acid, and 500 ml of salt A solution having a pH of 10 (due to addition of sodium carbonate to salt A solution). After decanting for about six hours, an oil of the same external appearance as test 1 was recovered as the major fraction in the upper layer.

TEST 3

There was subjected to agitation 1 liter of drained blackish oil, having a high rate activity, for about ten minutes at a temperature 40° C., using a mixture of 125 ml of salt A aqueous solution adjusted to pH 4, and 125 ml of salt A aqueous solution adjusted to pH 10 as additives to the dirty oil after about 10 hours of decanting and drawing off, as lower and intermediate phases, layers of water and black residues (about 2.5%), the totality of the upper oil layer was recovered.

(b) To evaluate the characteristics of the recovered oils, according to the above tests, standard analyses of the lubricating products were made and the following results were obtained.

| Measurement | Test 1 Oil | Test 2 Oil | Test 3 Oil |
|---|---|---|---|
| Viscosity at 37° 8C. in Centistokes (Standard NF T60.100) | 69.1 | 71.1 | 72.7 |
| Viscosity at 89° C. (as above) | 9.8 | 10.6 | 10.8 |
| Viscosity index (standard ASTM D 2270) | 136 | 146 | 145 |
| Density at 20° C. (standard NF T 60.101) | 0.878 | 0.882 | 0.877 |
| Sulfate ash (standard NF T 60.143) | 0.02% | 0.09% | 0.11% |
| Flash point (standard NF T 60.103) | 114° C. | 110° C. | 104° C. |
| Acid index (standard ASTM D644) | 0.60 | 0.60 | 0.60 |
| Basic index (standard ASTM D 664) | 0.40 | 0.70 | 0.65 |
| Flow point (standard NFT 60.105) | −30° C. | −32° C. | −31° C. |

When each and all of these characteristics are compared with those of new oils for lubricating engines, now on the market, it is noted that the oil products recovered after decanting, according to the invention, exhibit approximately the same performances. Additives usually used to dope base oils (paraffins, naphthenes, hydrogenated or synthetic), as, for example, agents improving the viscosity or cold flow point were not deteriorated by use of the process. In practice, the above results correspond to the characteristic of synthesis base oils, containing additives, of a grade SAE D 5 W30 used successfully as engine lubricants.

Of course, the invention is not limited to the above specific examples and operating conditions and extends to all variant embodiments included within the spirit and scope of the following claims which would be obvious to one of ordinary skill in the art.

I claim:

1. Process of treating nonedible oil products, particularly used lubricating and industrial oils, to recover a large fraction of directly reusable oil, consisting essentially of:

agitating the used oil in the presence of a quaternary ammonium salt containing at least one aryl ring, or a mixture of such salts, and then decanting and recovering the supernatant fraction as a regenerated oil.

2. Process according to claim 1 wherein the quaternary ammonium salt is an alkyl dimethylarylammonium halide in which the alkyl radical contains 8 to 18 carbon atoms.

3. Process according to either claim 1 or 2 wherein the portion of quaternary ammonium salt or mixture of salts varies between 0.1 and 3 parts per 100 parts by weight of used oil, said salt being used in the form of a dilute aqueous solution containing 5 to 30% by weight of quaternary ammonium salt.

4. Process according to claim 3 wherein the medium of used oil and quaternary ammonium salt is adjusted to a neutral or slightly acid pH.

5. Process according to claim 4 wherein the agitation is performed at a temperature between normal ambient temperature and about 50° C.

6. Process according to claim 5 wherein the oils treated are either machine oils, oils drained from vehicles, various industrial oils, hydraulic liquids, or fatty body liquid wastes.

7. Process according to claim 5 applied to treating acid black muds, which are obtained as residue from the acid regeneration treatment of used oils, wherein the supernatant fraction obtained after decanting is directly reusable as a regenerated oil, after neutralization of the acidity of the oil.

* * * * *